US007223033B2

(12) United States Patent
Huang et al.

(10) Patent No.: US 7,223,033 B2
(45) Date of Patent: May 29, 2007

(54) PINCH CONTROL IN A PRINTER

(76) Inventors: Xiaoxi Huang, 450, Alexandra Road, Singapore (SG) 119960; Kong Hock Lim, 450, Alexandra Road, Singapore (SG) 119960; Yonggang Zhang, 450, Alexandra Road, Singapore (SG) 119960; Ramanathan Alaganchetty, Blk 346, Ang Mo Kio Avenue 3, #08-2278, Singapore (SG) 560346

( * ) Notice: Subject to any disclaimer, the term of this patent is extended or adjusted under 35 U.S.C. 154(b) by 0 days.

(21) Appl. No.: 11/115,666

(22) Filed: Apr. 26, 2005

(65) Prior Publication Data

US 2006/0239750 A1 Oct. 26, 2006

(51) Int. Cl.
*B41J 13/076* (2006.01)
*B41J 13/002* (2006.01)
*B43L 13/00* (2006.01)

(52) U.S. Cl. ..... 400/636; 400/634; 400/639; 400/611; 400/636.3; 400/617; 400/235.1; 347/101; 226/176; 226/181

(58) Field of Classification Search ..... 400/636, 400/636.3, 617, 235.1, 471.1, 647.1, 639, 400/634, 611, 648; 226/176, 181, 183; 347/101, 347/134

See application file for complete search history.

(56) References Cited

U.S. PATENT DOCUMENTS

| | | | | |
|---|---|---|---|---|
| 3,029,991 | A * | 4/1962 | Von Allmen | 226/156 |
| 4,104,963 | A * | 8/1978 | Fortmann | 100/176 |
| 4,336,752 | A * | 6/1982 | Asakura et al. | 101/99 |
| 4,830,527 | A | 5/1989 | Kikuchi et al. | |
| 5,135,322 | A * | 8/1992 | Tsuru et al. | 400/639.1 |
| 5,455,604 | A * | 10/1995 | Adams et al. | 346/138 |
| 5,645,361 | A * | 7/1997 | Mitsushima et al. | 400/636 |
| 5,808,647 | A * | 9/1998 | Kurata et al. | 347/104 |
| 5,927,877 | A * | 7/1999 | Kelly et al. | 400/625 |
| 5,938,356 | A | 8/1999 | Wirth et al. | |
| 6,010,204 | A * | 1/2000 | Morioka et al. | 347/37 |
| 6,089,773 | A * | 7/2000 | Bailey et al. | 400/642 |
| 6,186,683 | B1 * | 2/2001 | Shibuki | 400/120.08 |
| 6,398,338 | B1 * | 6/2002 | Berg et al. | 347/32 |
| 2003/0053836 | A1 * | 3/2003 | Sivanandam et al. | 400/679 |
| 2004/0207707 | A1 | 10/2004 | Ohashi et al. | |
| 2005/0012800 | A1 | 1/2005 | Ohashi | |
| 2005/0046686 | A1 | 3/2005 | Iwakura et al. | |
| 2005/0047840 | A1 | 3/2005 | Ohashi | |
| 2005/0058493 | A1 | 3/2005 | Kida | |

FOREIGN PATENT DOCUMENTS

| | | | |
|---|---|---|---|
| JP | 03112695 A | * | 5/1991 |
| JP | 11208923 A | * | 8/1999 |

* cited by examiner

*Primary Examiner*—Ren Yan
*Assistant Examiner*—Matthew Marini

(57) ABSTRACT

A pinch control apparatus in a printer for controlling a pinch force exerted on a medium which is being fed into a printing zone is provided. The pinch control apparatus includes a camshaft rotatably mounted across a width of the medium, at least one cam attached to the camshaft, a plunger and a biasing rod. The cam has a predefined profile and is able to rotate with the camshaft. The plunger abuts the predefined profile of the at least one cam. The biasing rod extends from a pinch plate to the plunger to bias the pinch plate to a linefeed roller for exerting the pinch force on the medium therebetween. The pinch force exerted on the medium is controllable by the rotation of the camshaft.

26 Claims, 7 Drawing Sheets

PINCH CONTROL IN A PRINTER

FIELD OF THE INVENTION

The invention relates generally to printers, and more particularly to a pinch control in a printer for controlling a pinch force exerted on a medium.

BACKGROUND OF THE INVENTION

A printer generally uses a linefeed roller and an output roller to drive a medium in the printer during a printing process. The linefeed roller and the output roller are driven by a servo motor. A pick motor controls a pick system to pick up the medium, for example a paper, from an input tray and feeds it to the linefeed roller. The linefeed roller drives the paper into a printing area where droplets of ink are sprayed onto the paper from an ink cartridge.

One or more pinch rollers are biased against the linefeed roller so that the paper is driven between the pinch rollers and the linefeed roller. Since the pinch rollers are biased against the linefeed roller, a pinch force is exerted on the paper. The linefeed roller and the pinch rollers control the advancement of the paper during most of the printing process.

In some printing processes, once a bottom of form (BOF) edge of the paper leaves the linefeed roller and the pinch rollers (the pinching point), the output roller drags the paper from the printing area to an output tray. One or more star wheels are normally used together with the output roller to drag the paper from the printing area. The star wheels are located adjacent to the output roller, with the spikes of the star wheels touching the output roller. The paper is dragged out of the printing area between star wheels and the output roller.

The configuration of the printer described above allows the printer to continue to print on the paper even when the paper has left the pinching point. This enables the printed image on the paper to have very small BOF margin, or even full bleed printing.

However, paper positioning errors normally occur when the control of the driving of the paper is changed from the linefeed roller to the output roller. Such positioning errors are called BOF transition error (BOFTE). The BOFTE are more prominent in high quality photo printing. One of the main causes of BOFTE is the result of pinch rollers squeezing the bottom edge of the paper when the paper leaves the pinching point.

Special print mode may be applied during or after transition from the linefeed roller to the output roller to smoothen printing defects caused by BOFTE. It is also possible to use special print head swath shifting corresponding to the paper movement during the transition to minimize such printing defects. However, the printing defects caused by BOFTE still could not be eliminated using such methods, and these methods may also cause additional printing defects.

It is desirable to provide a method and a system to reduce BOFTE in small BOF margin and full bleed printing.

SUMMARY OF THE INVENTION

In an embodiment, a pinch control apparatus in a printer for controlling a pinch force exerted on a medium which is being fed into a printing zone is provided. The pinch control apparatus includes a camshaft rotatably mounted across a width of the medium, at least one cam attached to the camshaft, a plunger and a biasing rod. The cam has a predefined profile and is able to rotate with the camshaft. The plunger abuts the predefined profile of the at least one cam. The biasing rod extends from a pinch plate to the plunger to bias the pinch plate to a linefeed roller for exerting the pinch force on the medium therebetween. The pinch force exerted on the medium is controllable by the rotation of the camshaft.

BRIEF DESCRIPTION OF THE DRAWINGS

The embodiments of the invention will be better understood in view of the following drawings and the detailed description.

DETAILED DESCRIPTION OF THE INVENTION

Figure 1:
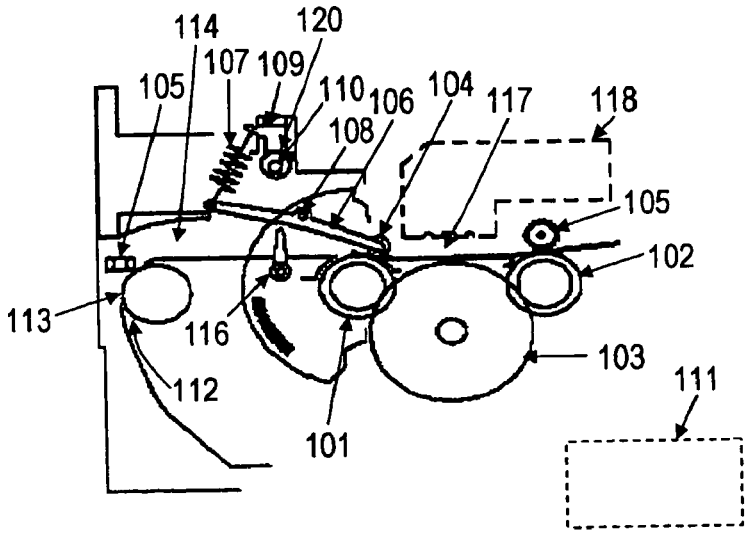
FIG. 1 shows a cross-sectional view of a part of a paper driving mechanism in a printer.

FIG. 1 shows a cross-sectional view of a part of a paper driving mechanism in a printer. The paper driving mechanism includes a linefeed roller 101, an output roller 102, a servo motor 103, a pinch roller 104 and a star wheel 105. The servo motor 103 drives the linefeed roller 101 and the output roller 102. The pinch roller 104 is mounted at one end of a pinch plate 106. The other end of pinch plate 106 is attached to a spring 107. The pinch plate 106 is pivoted 108 between the two ends. The pinch roller 104 is biased by the spring 107 to the linefeed roller 101.

Although only one pinch plate 106 is shown, and one spring 107 is attached to the pinch plate 106, it should be noted that it is possible that the paper driving mechanism includes more than one pinch plates 106 with one or more springs 107 attached to each pinch plate 106 in other embodiments. Also, each pinch plate 106 may include one or more mounted pinch rollers 104. Similarly, the paper driving mechanism may also include more than one star wheels 105 in other embodiments.

The spring 107 is attached to the pinch plate 106 at one end, and to a plunger 109 at the other end. The plunger 109 sits or abuts on a cam 120 which is attached to a camshaft 110. The structure of the plunger 109, the cam 120 and the camshaft 110 will be described in greater detail later.

Figure 2:
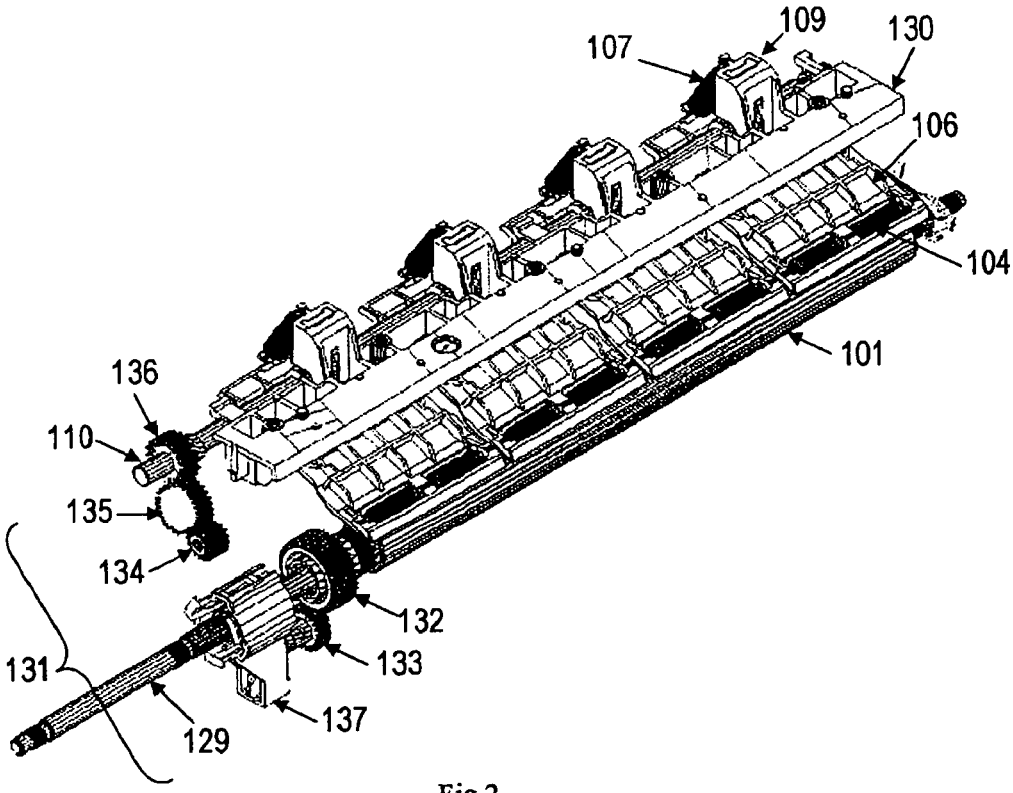
FIG. 2 shows an isometric view of a pinch control apparatus with a pinch support holder and a transmission gear train according to an embodiment.

FIG. 2 shows an isometric view of the pinch control apparatus with a pinch support holder 130 and a transmission gear train 131. It can be seen that the pinch control apparatus includes four plungers 109, four springs 107 and four pinch plates 106. Each spring 107 is attached to one of the plungers 109. It should however be noted that the pinch control apparatus may include any number of plungers 109, springs 107, and pinch plates 106 in other embodiments. The camshaft 110 is supported by the pinch support holder 130, and is rotatable with respect to the pinch support holder 130. In an embodiment, the pinch plate 106 is pivoted 108 on the pinch support holder 130.

The transmission gear train 131 transfers a torque or rotation from a pick motor 145 (see FIG. 7) to the camshaft 110. The transmission gear train 131 has a reduction ratio of 18.9 in one embodiment. The pick motor 145 is normally engaged to a pick system in a printer to pick paper from an input tray and feeds it to a turn roller 113. The turn roller 113 then feeds the paper to the linefeed roller 101 which drives the paper for printing.

The transmission gear train 131 includes an idler gear 132 rotatably mounted on a same shaft 129 of the linefeed roller 101, a selector gear 133, two connecting gears 134, 135 and a camshaft gear 136. The idler gear 132 is able to rotate independently from the shaft 129 of the linefeed roller 101. The selector gear 132 is engaged to the idler gear 133, and can be selected using a selector mechanism 137 to be engaged with the connecting gear 134 or with another system such as the pick system.

Figure 3A:
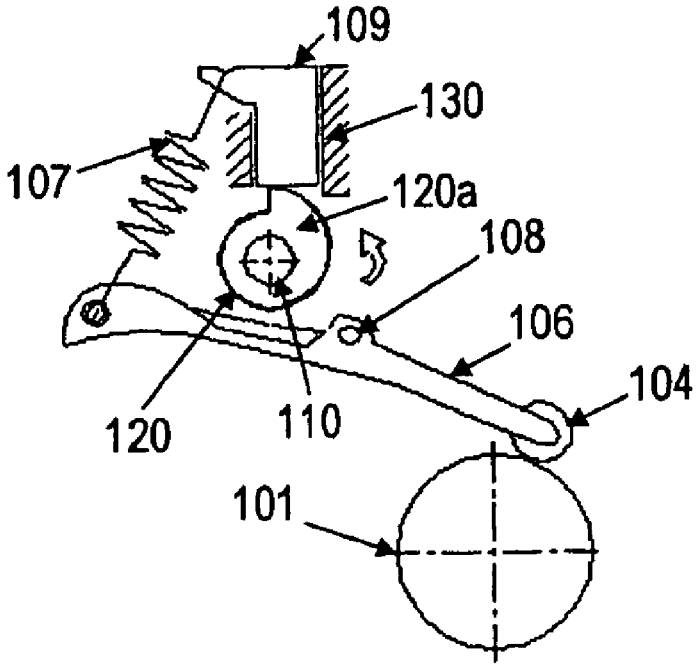
FIG. 3*a* shows a cross-sectional view of the pinch control apparatus with a cam in a home position according to an embodiment.
Figure 3B:
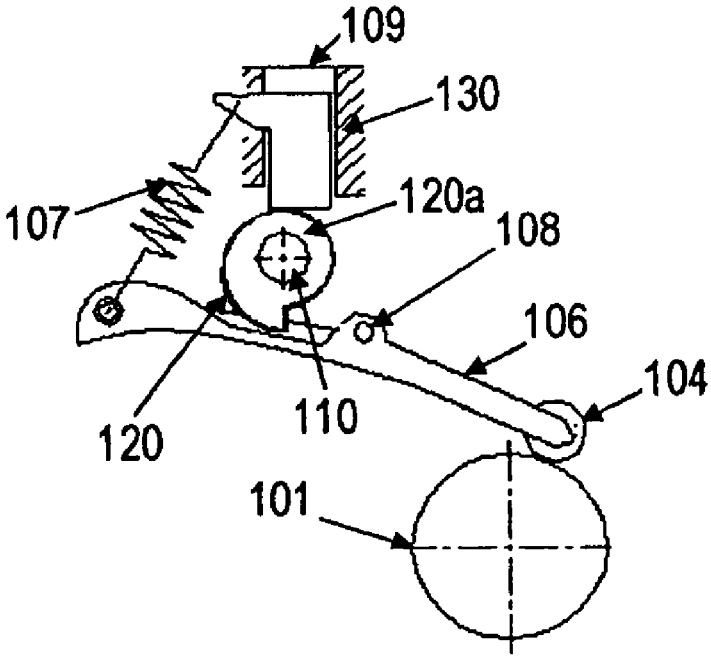
FIG. 3*b* shows the cross-sectional view of the pinch control apparatus with the cam in a position where the pinch force exerted by the pinch roller on the linefeed roller is zero according to an embodiment.

FIG. 3*a* shows a cross-sectional view of the pinch control apparatus according to an embodiment. A cam 120 is provided on the camshaft 10, and has a predefined profile 120*a*. The plunger 109 sits on or abuts the profile 120*a* of the cam 120. The profile 120*a* of the cam 120 is defined in such a manner that a rotation of the camshaft 110 in a counter-clockwise direction causes the distance between the plunger 109 and the camshaft 110 to decrease. FIG. 3*b* shows a cross-sectional view of the pinch control apparatus when the cam 120 is rotated in a counter-clockwise direction. As can be seen from FIG. 3*b*, the distance between the plunger 109 and the camshaft 110 has decreased compared to that in FIG. 3*a*. As a result, the biasing force of the spring 107, and hence, the force exerted by the pinch rollers 104 on the linefeed roller 101 is decreased.

Figure 4:
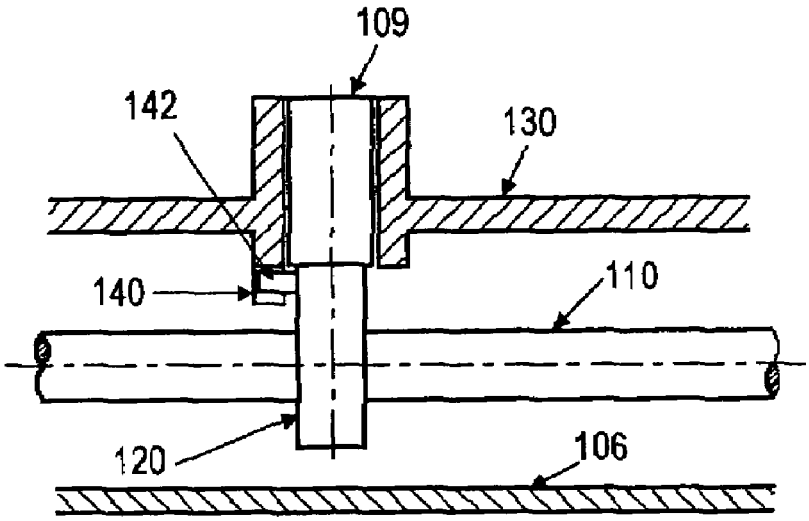
FIG. 4 shows a cross-sectional view of a protrusion of the pinch support holder acting as a stopper for the cam according to an embodiment.

The pinch support holder 130 may also include a protrusion 140 for the cam 120 as shown in FIG. 4. Similarly, the cam 120 also includes a corresponding protrusion 142. When the camshaft 110 is rotated in the clockwise direction beyond a certain point, the protrusion 142 of the cam 120 is restrained by the protrusion 140 of the pinch support holder. Therefore, any further clockwise rotation of the camshaft 110 is prevented.

Accordingly, the protrusion 140 of the pinch support holder 130 acts as a stopper for the cam 120 and prevents the rotation of the camshaft 110 in the clockwise direction beyond an end point. Therefore the protrusion 140 may be used as a hard stop for firmware identification and counts reset for the rotation of the camshaft in the clockwise direction. The hard stop is also referred as a home position of the camshaft 110.

In an embodiment, each spring 107 delivers approximately 650 grams of force on the pinch plate 106 when the camshaft 110 is in the home position. To keep the home position of the camshaft 110 and the force exerted by spring 107 on the pinch plate 106 stable, a 10 degrees counter-clockwise rotation of the camshaft 110 from the home position keeps the plunger 109 in the same position with respect to the camshaft 110. Therefore, the design of the pinch control apparatus according to the embodiment is robust to any undesirable changes in the force exerted by the spring 107 due to any slight movement of the camshaft 110 at the home position. Such design robustness of the pinch control apparatus is advantageous as the constant force of approximately 650 grams exerted by the pinch plate 106 can be ensured without the need for a precise calibration of the position of the camshaft 110 to the home position.

As the camshaft 10 is further rotated 180 degrees in the counter-clockwise direction, the force exerted by the spring 107 on the pinch plate 106, and hence the pinch force exerted on the linefeed roller 101, decreases to approximately 0 grams. When the camshaft 100 is rotated a further 10 degree in the counter-clockwise direction beyond this point, the pinch force exerted on the linefeed roller 101 is maintained as zero.

It should be noted that the degrees of rotation of the camshaft 110 and its corresponding force exerted by the springs 107 in the above-described embodiment only illustrate one manner of implementation. Any combination of the degrees of rotation of the camshaft 110 and the corresponding forces exerted by the springs 170 are possible in other embodiments.

Figure 5:
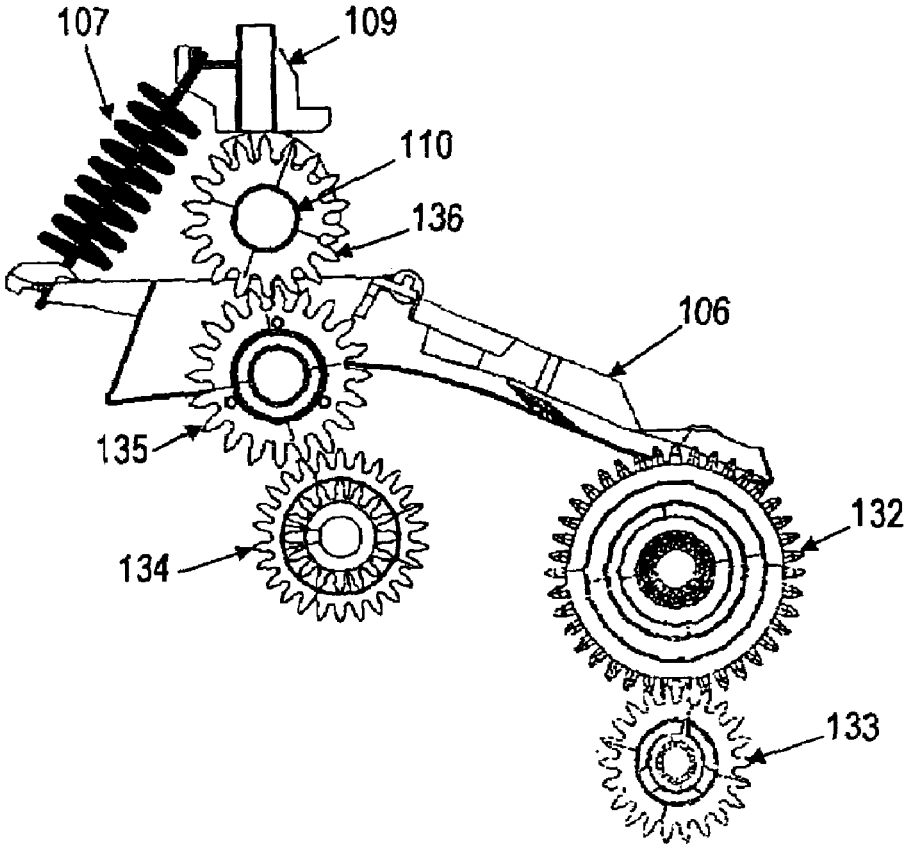
FIG. 5 shows the transmission gear train with a selector gear disengaged from a connecting gear according to an embodiment.
Figure 6:
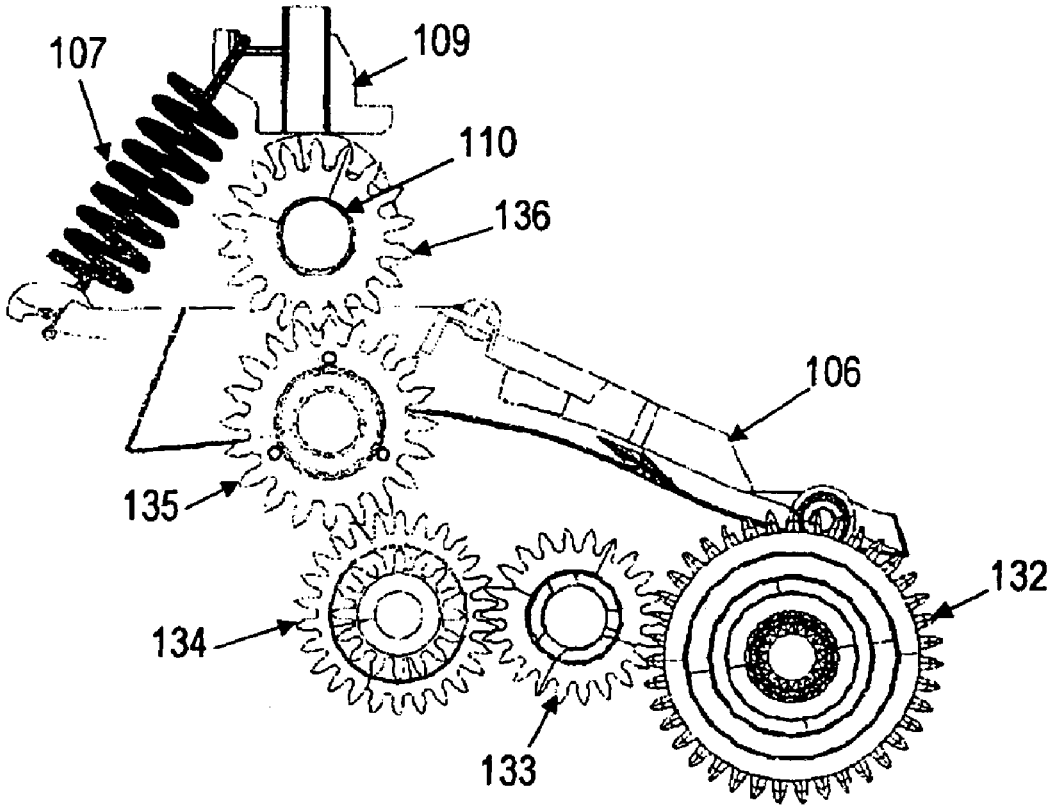
FIG. 6 shows the transmission gear train with the selector gear engaged with the connecting gear according to an embodiment.

FIG. 5 shows the transmission gear train 131 with the selector gear 133 disengaged from the connecting gear 134. FIG. 6 shows the transmission gear train 131 with the selector gear 133 engaged with the connecting gear 134.

Figure 7:
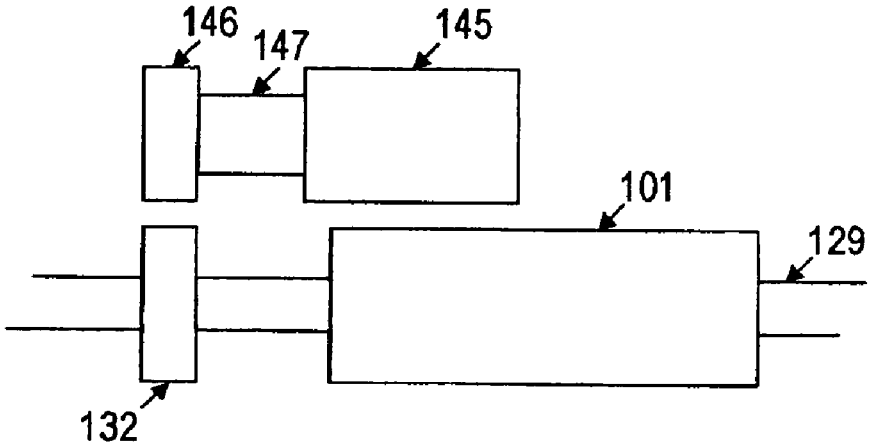
FIG. 7 shows a cross-sectional of a pick motor and its relation with an idler gear of the transmission gear train according to an embodiment.

FIG. 7 shows a cross-sectional view of the pick motor 145 and its relation to the idler gear 132 in an embodiment. The pick motor 145 drives a pick motor gear 146 using a rotating shaft 147. The pick motor gear 146 is engaged with the idler gear 132. The rotation of the pick motor gear 146 causes the idler gear 132 to rotate. It can be seen that a clockwise rotation of the pick motor gear 146 by the pick motor 145 results in the counter-clockwise rotation of the camshaft 10. Similarly, a counter-clockwise rotation of the pick motor gear 146 results in the clockwise rotation of the camshaft 110.

It should be noted that it is also possible to use a separate motor in another embodiment for directly rotating the camshaft 110. In this embodiment, the rotation of the camshaft 110 is not controlled by the pick motor 145. Therefore, the transmission gear train 131 for connecting the pick motor 145 to the camshaft 110 is not needed.

When a print job is initiated, a medium, such as a paper, is picked from an input tray 111. The paper travels along a path indicated by the arrow 112 (see FIG. 1) and is driven by a turn roller 113 into a paper guiding zone 114. A paper sensor 115 senses the presence of the paper in the guiding zone 114 and an Out Of Paper Sensor (OOPS) 116 senses the Bottom of Form (BOF) edge of the paper.

During a printing process, the paper in the guiding zone 114 is driven into a printing zone 117 by the linefeed roller 101 and the pinch rollers 104. In the printing zone 117, droplets of ink are ejected from an ink cartridge 118 onto the paper. Once the OOPS detects that the paper BOF edge of the paper is leaving the linefeed roller 110, the linefeed pinching force is released. Hence, the output roller 102 and the star wheels 105 drive the paper from the printing zone 117 into an output tray (not shown).

Figure 8:
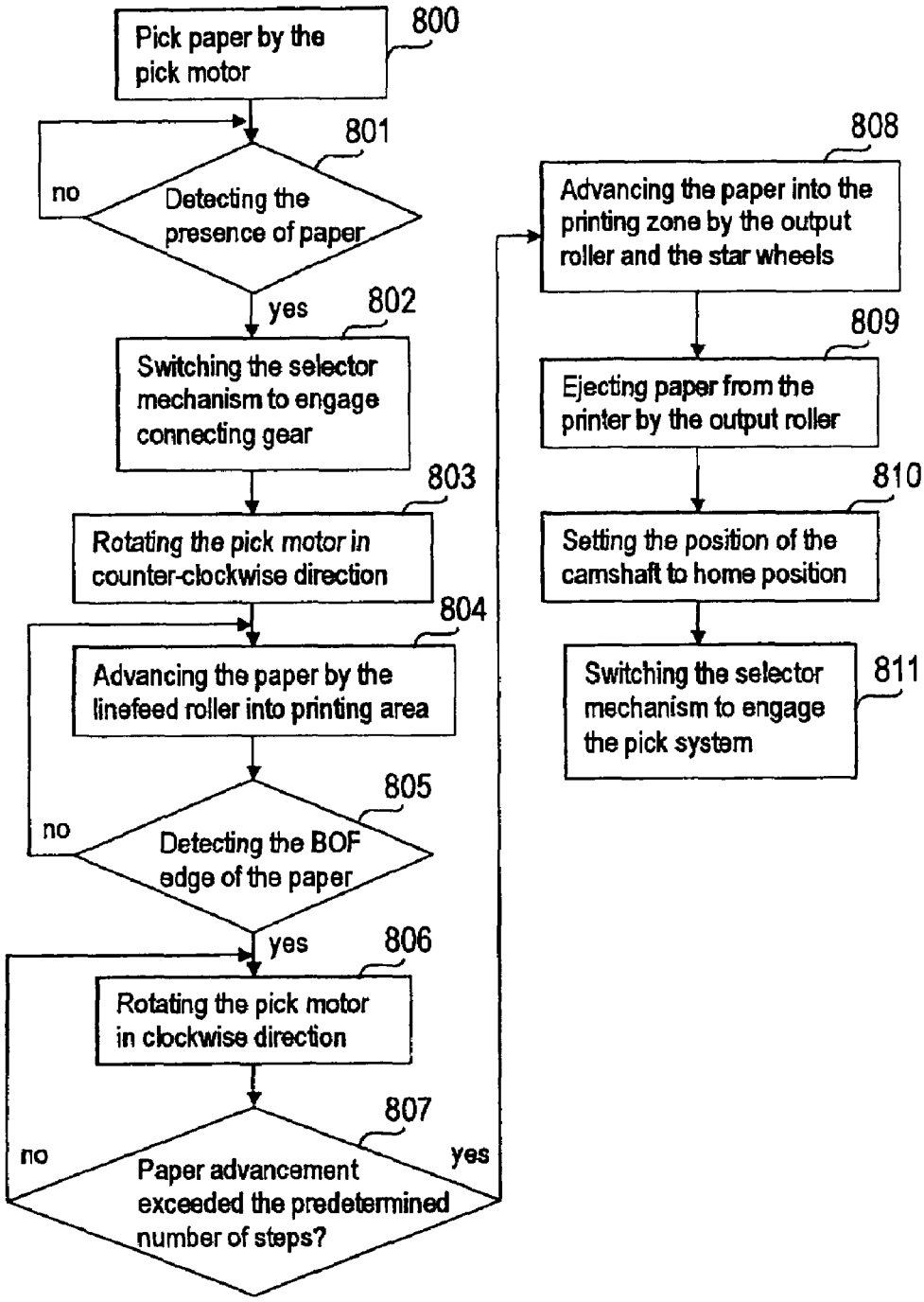
FIG. 8 shows a flow chart of a printing process with pinch control according to an embodiment.

FIG. 8 shows a flow chart of a printing process for printing on paper according to an embodiment. Step 800 includes picking a paper by the pick motor 145. Step 801 includes detecting the presence of paper using a sensor 115 provided in the guiding zone 114 of the printer. Step 802 includes switching the selector mechanism 137 to engage the selector gear 133 to the connecting gear 134 when the paper is detected.

Step 803 includes rotating the pick motor 145 in the counter-clockwise direction until the cam 120 touches the protrusion 140 of the pinch support holder 130. This step 803 ensures the camshaft 110 is in its home position.

Step 804 includes advancing the paper by the linefeed roller 101 into the printing area 117 to be printed. The paper is advanced into the printing area 117 in a series of paper advancement steps. Step 805 includes detecting the bottom of form (BOF) edge of the paper. The BOF edge of the paper can be detected using the Out-Of-Paper Sensor (OOPS) 116 in an embodiment. Step 806 includes rotating the pick motor 145 in the clockwise direction corresponding to the paper advancement. Specifically, the pick motor 145 is rotated in the clockwise direction in predefined steps or counts for every certain number of paper advancement steps. Each predefined step or count of the pick motor 145 translates to a counter-clockwise rotation of the camshaft 110. The pinch force exerted on the paper between the pinch rollers 104 and the linefeed roller 101 decreases when the pick motor 145 is rotated in the clockwise direction. The pinch force exerted on the paper gradually becomes zero when the paper has advanced a predetermined number of steps.

Step 807 includes checking if the paper advancement has exceeded the predetermined number of steps for the pinch force to become zero. Step 808 includes advancing the paper into the printing zone 117 by the output roller 102 and the star wheels 105 for BOF printing when the pinch force becomes zero. When the printing is completed, the paper is ejected by the output roller 102 in step 809.

Step 810 includes resetting the position of the camshaft 110 to the home position by rotating the pick motor 145 in the counter-clockwise direction. This sets the camshaft 110 back to its home position so that the spring 170 delivers a biasing force of 650 g to the pinch plate 106. Step 811 includes switching the selector mechanism 137 to engage the selector gear 133 to the pick system for picking another paper into the guiding zone. Steps 800 to 810 are repeated for controlling the pinch force on another paper during the printing process.

The pinch control apparatus as described in the above embodiments allows the pinch force exerted on the paper to be gradually reduced to zero before the BOF edge of the paper leaves the pinching point. Therefore, a watermelon seed effect causing paper feeding error during a transitional point from the linefeed roller to the output roller is eliminated. The watermelon seed effect is a phenomenon when the pinch rollers squeezes the bottom edge of the paper during printing, and causing the paper to over advance (pushed forward suddenly) when the bottom edge leaves the pinch point. The watermelon seed effect is one of the main causes of Bottom of Form Transition Error (BOFTE) as already described earlier.

Figure 9A:
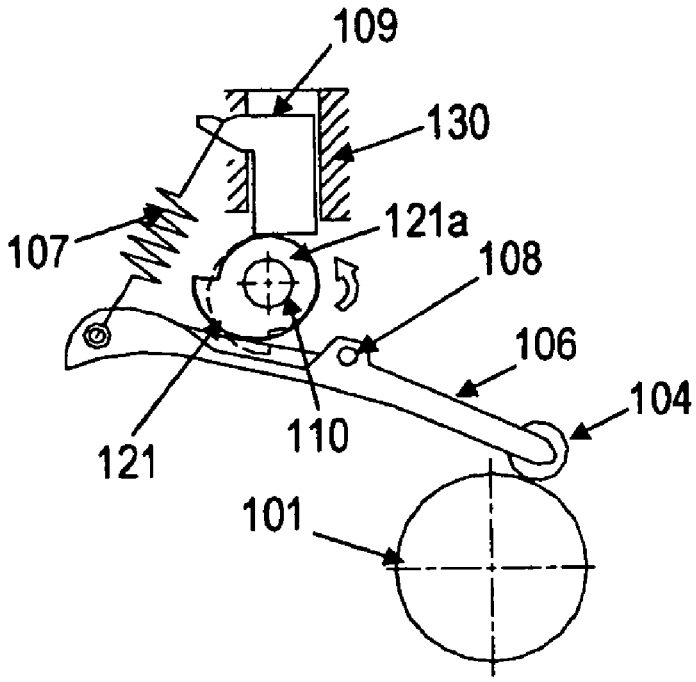
FIG. 9*a* shows a cross-sectional view of the pinch control apparatus having a second cam according to an embodiment.

In an embodiment, the camshaft 110 further includes a second cam 121 arranged adjacent to each cam 120. The second cam 121 has a profile 121*a* which abuts the pinch plate 106 as shown in FIG. 9*a* and FIG. 9*b*.

Figure 9B:
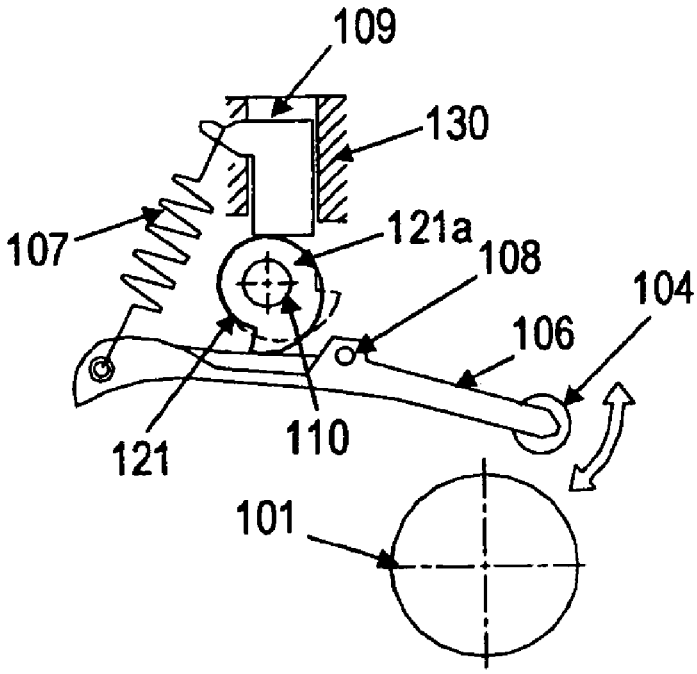
FIG. 9*b* shows the cross-sectional view of the pinch control apparatus with the second cam in a position pushing the pinch plate, resulting in the pinch roller to be lifted away from the linefeed roller according to an embodiment.

The profile 121*a* of the second cam 121 is defined in a manner such that when the camshaft 110 is rotated in the counter-clockwise direction beyond the position when the pinch force exerted on the linefeed roller 101 has decreased to zero, the end of the pinch plate 106 where the springs 107 are attached to are pushed away from the camshaft 110 by the second cam 121 as shown in FIG. 9*b*. As a result, the pinch plate 106 is rotated about its pivoted point 108, causing the other end of the pinch plate 106 where the pinch rollers 104 are mounted on to be lifted from the linefeed roller 101.

Figure 10:
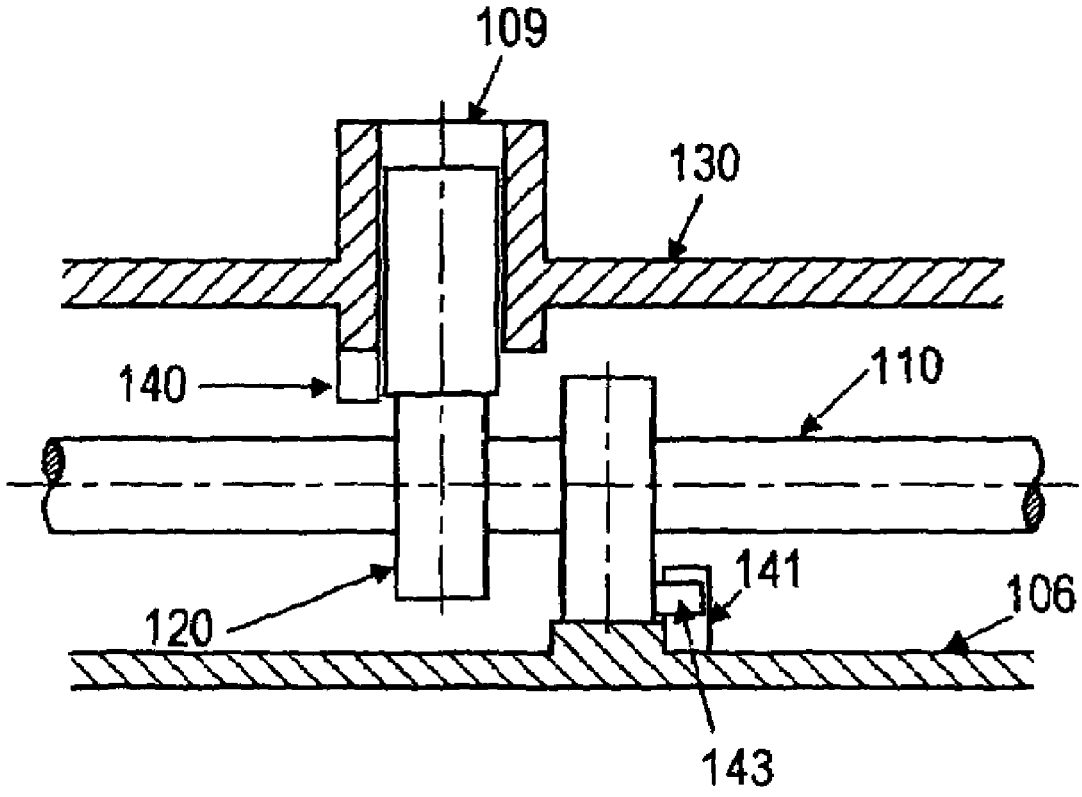
FIG. 10 shows a cross-sectional view of a protrusion of the pinch plate acting as a stopper for the second cam according to an embodiment.

A final hard stop may be provided as an end point for the rotation of the camshaft 110 in the counter-clockwise direction. The final hard stop may be provided as a protrusion 141 extending from the pinch plate 106 as shown in FIG. 10 in one embodiment. In this embodiment, the second cam 121 includes a corresponding protrusion 143. When the camshaft 110 is rotated in the counter-clockwise direction beyond the end point, the protrusion 143 of the second cam 121 is restrained by the protrusion 141 of the pinch plate 106. Therefore, any further counter-clockwise rotation of the camshaft 110 is prevented. The final hard stop may also be controlled by motor stall torque values using firmware in another embodiment.

Thus the embodiment described above not only is able to control the pinch force exerted on the medium during printing, but is also able to control the lifting of the pinch rollers 104 from the linefeed roller 101. The lifting of the pinch rollers 104 from the linefeed roller 101 allows the paper to be reversed into the guiding zone 114 even when the paper has left the pinching point. This allows small margin or even borderless duplex printing even when a duplexer is arranged at a rear end of the printer. The lifting of pinch rollers 104 may also allow a thick medium, such as a CD, to be fed into the paper guiding zone 114 from a front end of the printer (the same end where the input and output tray are) for printing.

It should also be noted that the pinch force exerted on the medium may be adjusted to any desired level according to different media properties for different print jobs. Also, by varying the profiles 120*a* of the cams 120, different pinch force may be applied on the medium from different pinch plates 106 in accordance to any special print requirements. Furthermore, pinch rollers may be separately controlled to be lifted from the linefeed roller, and hence from the medium, during printing by varying the profiles 120*a* of the cams 120 of the different pinch plates 106. This separate control of pinch plates 106 lifting can be used to prevent certain area of printed media from being contacted by the pinch rollers 104.

Although the present invention has been described in accordance with the embodiments as shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed:

1. A pinch control apparatus in a printer for controlling a pinch force exerted by a pinch plate on a medium which is being fed into a print zone, the pinch control apparatus comprising:

a camshaft rotatably mounted across a width of the medium;

at least one cam attached to the camshaft, said at least one cam having a predefined profile and is rotatable with the camshaft;

at least one pinch plate lifting cam attached to the camshaft, said at least one pinch plate lifting cam having a predefined profile which abuts the pinch plate and is rotatable with the camshaft;

a plunger which abuts the predefined profile of said at least one cam; and a biasing rod extending from the plunger to the pinch plate for biasing the plunger to the predefined profile of said at least one cam such that the plunger is always in contact with the predefined profile of said at least one cam and the pinch plate is always in contact with the predefined profile of said at least one pinch plate lifting cam, wherein the pinch force exerted on the medium and lifting of the pinch plate are controllable by the rotation of the camshaft.

2. The pinch control apparatus according to claim 1, wherein the biasing rod is a spring.

3. The pinch control apparatus according to claim 1, wherein the biasing rod extends from a first end of the pinch plate, thereby biasing a second end of the pinch plate to a linefeed roller.

4. The pinch control apparatus according to claim 3, wherein the pinch plate is pivoted between the first end and the second end.

5. The pinch control apparatus according to claim 4, wherein the predefined profile of said at least one cam is defined such that when the plunger is abutted at any point of the predefined profile of said at least one cam, the rotation of the camshaft in a first direction causes the plunger to move away from the camshaft, thereby increasing the pinch force exerted on the medium, and the rotation of the camshaft in a second direction causes the plunger to move toward the camshaft, thereby reducing the pinch force on the medium.

6. The pinch control apparatus according to claim 5, wherein the predefined profile of said at least one pinch plate lifting cam abuts the pinch plate near the first end.

7. The pinch control apparatus according to claim 6, wherein the predefined profile of said at least one pinch plate lifting cam is defined such that the rotation of the camshaft in the second direction pushes the first end of the pinch plate away from the camshaft, thereby lifting the second end of the pinch plate from the linefeed roller.

8. The pinch control apparatus according to claim 1 further comprising a plurality of gears which are interconnectable from a pick motor to the camshaft for transferring a torque from the pick motor to the camshaft.

9. The pinch control apparatus according to claim 8 further comprising a selector for engaging and disengaging the gears from the pick motor to the camshaft.

10. The pinch control apparatus according to claim 1 further comprising a motor for rotating the camshaft.

11. The pinch control apparatus according to claim 1 further comprising a pinch support holder wherein the camshaft is rotatably mounted thereon.

12. The pinch control apparatus according to claim 11, wherein the pinch support holder comprises at least one protrusion for preventing the camshaft from rotating beyond an end point in a first direction.

13. The pinch control apparatus according to claim 12, wherein the pinch plate comprises at least one protrusion for preventing the camshaft from rotating beyond an end point in a second direction.

14. A printer comprising:

at least one pinch plate exerting a pinch force on a medium between said at least one pinch plate and a linefeed roller;

a camshaft rotatably mounted across a width of the medium;

at least one cam attached to the camshaft, the cam having a predefined profile and is rotatable with the camshaft;

at least one pinch plate lifting cam attached to the camshaft, said at least one pinch plate lifting cam having a predefined profile which abuts the pinch plate and is rotatable with the camshaft;

a plunger which abuts the predefined profile of said at least one cam; and a biasing rod extending from said at least one pinch plate to the plunger for biasing the plunger to the predefined profile of said at least one cam such that the plunger is always in contact with the predefined profile of said at least one cam and the pinch plate is always in contact with the predefined profile of said at least one pinch plate lifting cam, wherein the pinch force exerted on the medium and lifting of the pinch plate from the linefeed roller are controllable by the rotation of the camshaft.

15. The printer according to claim 14, wherein the biasing rod is a spring.

16. The printer according to claim 14, wherein the biasing rod extends from a first end of said at least one pinch plate, thereby biasing a second end of said at least one pinch plate to the linefeed roller.

17. The printer according to claim 16, wherein said at least one pinch plate is pivoted between the first end and the second end.

18. The printer according to claim 17, wherein the predefined profile of said at least one cam is defined such that when the plunger is abutted at any point of the predefined profile of said at least one cam, the rotation of the camshaft in a first direction causes the plunger to move away from the camshaft, thereby increasing the pinch force exerted on the medium, and the rotation of the camshaft in a second direction causes the plunger to move toward the camshaft, thereby reducing the pinch force on the medium.

19. The printer according to claim 18, wherein the predefined profile of said at least one pinch plate lifting cam abuts the pinch plate near the first end.

20. The printer according to claim 19, wherein the predefined profile of said at least one pinch plate lifting cam is defined such that the rotation of the camshaft in the second direction causes the first end of said at least one pinch plate to move away from the camshaft, thereby lifting the second end of the at least one pinch plate from the linefeed roller.

21. The printer according to claim 14 further comprising a plurality of gears which are interconnectable from a pick motor to the camshaft for transferring a torque from the pick motor to the camshaft.

22. The printer according to claim 21 further comprising a selector for engaging and disengaging the gears from the pick motor to the camshaft.

23. The printer according to claim 14 further comprising a motor for rotating the camshaft.

24. The printer according to claim 14 further comprising a pinch support holder wherein the camshaft is rotatably mounted thereon.

25. The printer according to claim 24, wherein the pinch support holder comprises at least one protrusion for preventing the camshaft from rotating beyond an end point in a first direction.

26. The pinch control apparatus according to claim 25, wherein said at least one pinch plate comprises at least one protrusion for preventing the camshaft from rotating beyond an end point in a second direction.

* * * * *

UNITED STATES PATENT AND TRADEMARK OFFICE

CERTIFICATE OF CORRECTION

PATENT NO. : 7,223,033 B2
APPLICATION NO. : 11/115666
DATED : May 29, 2007
INVENTOR(S) : Xiaoxi Huang et al.

It is certified that error appears in the above-identified patent and that said Letters Patent is hereby corrected as shown below:

In column 3, line 42, after "camshaft" delete "10," and insert -- 110, --, therefor.

In column 4, line 20, after "camshaft" delete "10" and insert -- 110 --, therefor.

In column 4, line 46, after "camshaft" delete "10." and insert -- 110. --, therefor.

Signed and Sealed this

Thirteenth Day of April, 2010

David J. Kappos

David J. Kappos
*Director of the United States Patent and Trademark Office*